US006170473B1

(12) United States Patent
Pontoppidan

(10) Patent No.: US 6,170,473 B1
(45) **Date of Patent: *Jan. 9, 2001**

(54) DISCHARGING BY-PASS FOR HIGH PRESSURE DIRECT INJECTION PUMP

(75) Inventor: Michaël Pontoppidan, Colombes (FR)

(73) Assignee: Magneti Marelli France (FR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/423,112

(22) PCT Filed: May 6, 1998

(86) PCT No.: PCT/FR98/00911

§ 371 Date: Oct. 29, 1999

§ 102(e) Date: Oct. 29, 1999

(87) PCT Pub. No.: WO98/51921

PCT Pub. Date: Nov. 19, 1998

(30) Foreign Application Priority Data

May 9, 1997 (FR) ..... 97 05724

(51) Int. Cl.[7] ..... F02M 33/04
(52) U.S. Cl. ..... 123/514; 123/179.17
(58) Field of Search ..... 123/446, 506, 123/457–8, 179.16, 179.17, 514, 456, 510–11

(56) References Cited

U.S. PATENT DOCUMENTS

| | | | | |
|---|---|---|---|---|
| 5,207,203 | * | 5/1993 | Wagner et al. | 123/514 |
| 5,558,068 | | 9/1996 | Akira et al. | 123/516 |
| 5,626,121 | * | 5/1997 | Kushida et al. | 123/514 |
| 6,024,064 | * | 2/2000 | Kato et al. | 123/179.17 |
| 6,065,436 | * | 5/2000 | Koga et al. | 123/179.17 |

FOREIGN PATENT DOCUMENTS

| | | |
|---|---|---|
| 33 15 927 | 11/1983 | (DE) . |
| 195 39 885 | 11/1996 | (DE) . |
| 0 643 219 | 3/1995 | (EP) . |

* cited by examiner

*Primary Examiner*—Thomas N. Moulis
(74) *Attorney, Agent, or Firm*—Piper, Marbury, Rudnick & Wolfe

(57) ABSTRACT

The invention concerns a relief device for a high-pressure direct-injection pump supplying petrol to an automobile vehicle engine injector manifold, the pump being supplied with fuel by a low-pressure electric fuel pump communicating with a fuel tank and the high pressure delivered being regulated by a pressure regulator, said pressure regulator taking the form of a three-way valve supplying fuel to the manifold via the fuel pump below a predetermined engine rotation speed threshold and then supplying the manifold via the top part of the injection pump when the engine speed is above the predetermined threshold.

6 Claims, 2 Drawing Sheets

DISCHARGING BY-PASS FOR HIGH PRESSURE DIRECT INJECTION PUMP

FIELD OF THE INVENTION

The present invention concerns a relief bypass device for a high-pressure direct-injection pump for feeding petrol to an injector manifold of an automobile vehicle internal combustion engine.

BACKGROUND OF THE INVENTION

Petrol engines for automobile vehicles currently being developed emit large quantities of carbon dioxide ($CO_2$) into the atmosphere, at a rate of approximately 170 g of $CO_2$ per 100 km travelled, as well as other emissions.

To meet draft European anti-pollution standards that will come into force in 2005, automobile vehicle engines will have to operate in a way that reduces $CO_2$ emission by approximately 25%, i.e. to approximately 120 g.

The quantity of $CO_2$ emitted is directly proportional to the fuel consumption of the engine and the solutions adopted are therefore directed to reducing fuel consumption.

A first solution based on the concept of indirect sequential injection into an inlet manifold upstream of the inlet valves uses an impoverished air/petrol mixture. However, the results of this solution are limited in that a too poor mixture leads to incorrect engine operation.

A second solution, referred to as "direct-injection", consists in placing injectors directly in a combustion chamber of the engine. According to this concept, on the one hand, the injector is subject to downstream pressure variations associated with the Beau de Rochas cycle and, on the other hand, the petrol injected must be metered very accurately. To this end, a high-pressure injection pump associated with a pressure regulator is used to supply fuel at high pressure to the injectors.

The high-pressure injection pump is a mechanical pump driven by the engine of the automobile vehicle. The rotation speed of the pump therefore depends on the engine speed.

The pressure regulator is therefore unable to assure a stable pressure at the injectors at particularly low engine speeds, for example during starting, which is prejudicial to good combustion.

An object of the present invention is to remedy the drawbacks referred to above by providing a device producing a stable petrol pressure at the injectors in order to reduce the fuel consumption and the level of $CO_2$ emission without degrading engine performance.

Another object of the invention is to reduce the residual petrol pressure in the injectors when the motor is stopped or if the electrical power supply to a vehicle engine control system is cut off.

SUMMARY OF THE INVENTION

To this end, the present invention consists in a relief device for a high-pressure direct-injection pump for feeding petrol to a manifold of injectors of an automobile vehicle internal combustion engine, the high-pressure pump being connected by a feed pipe to a low-pressure electrical fuel pump which communicates with a fuel tank and the high pressure delivered being regulated by a pressure regulator, characterised in that the pressure regulator is a three-way regulator with three ports, a first port connecting the high-pressure pump to the manifold of the injectors, a second port connecting the high-pressure pump to the tank and a third port connecting the fuel pump to the manifold of the injectors, the second port being selectively open in normal operation, the first port being closed when the third port is open and vice versa in operation from an electrical power supply, the third port being:

normally open when the electrical fuel pump is not switched on, in which case the second port is forced open, held open during the engine starting phase, the fuel pump being energised to supply petrol at a stable low pressure to the injectors, and closed when the engine speed reaches a predetermined threshold corresponding to a rotation speed of the high-pressure pump adapted to supply petrol at a stable high pressure to the injectors.

The device in accordance with the invention can further include one or more of the following features:

the port B connects the high-pressure pump directly to the tank;

the port B is connected to the feed pipe downstream of the fuel pump;

the pressure delivered by the fuel pump is regulated by a low-pressure regulator;

the third port C is at least partly integrated into the three-way pressure regulator; and the third port C is fully integrated into the three-way pressure regulator.

BRIEF DESCRIPTION OF THE DRAWINGS

Two embodiments of the invention will now be described with reference to the accompanying drawings, in which.

DESCRIPTION OF PREFERRED EMBODIMENTS

Figure 1:
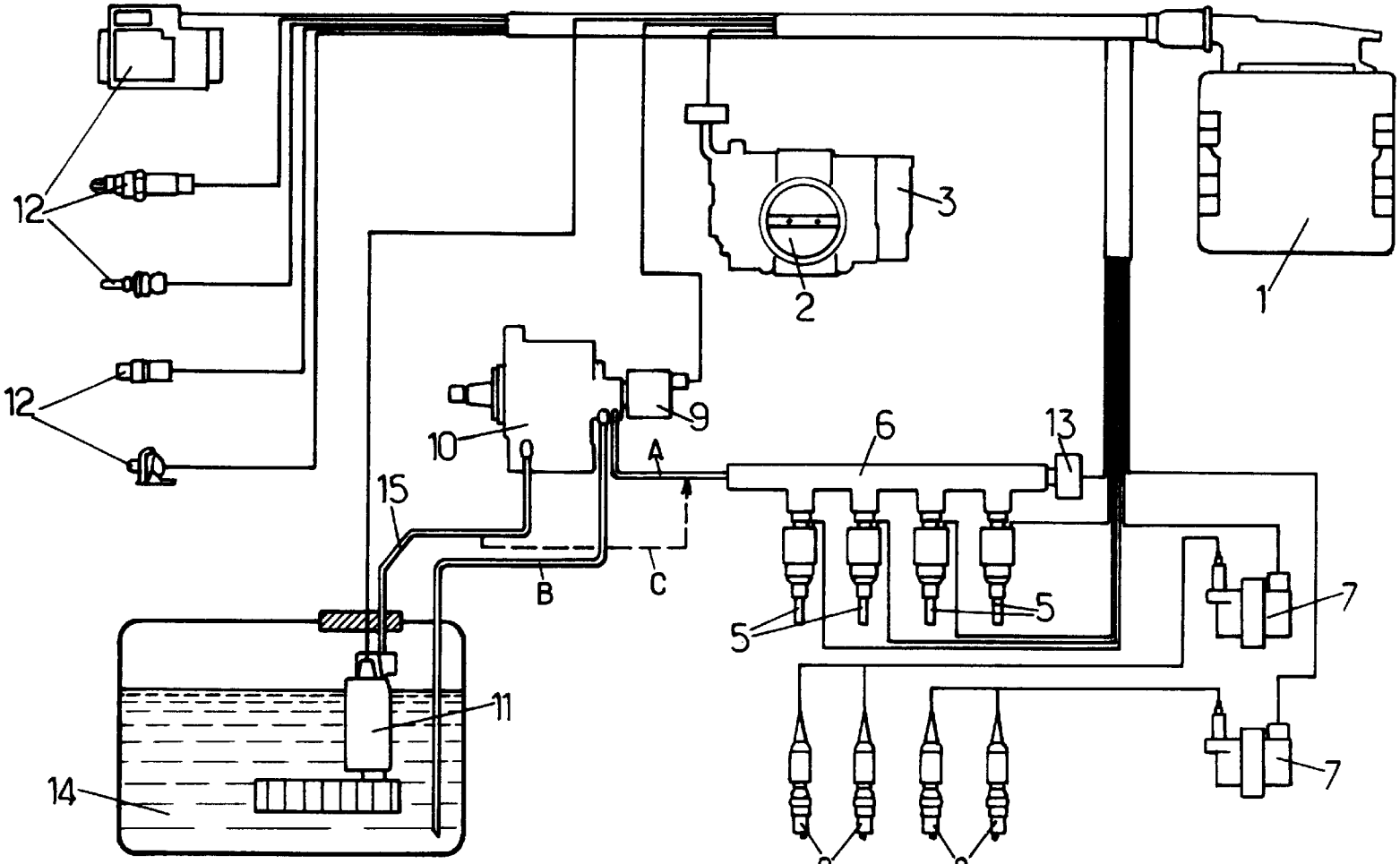
FIG. 1 is a diagram showing a first embodiment of the relief device in accordance with the invention for a high-pressure direct-injection pump.

The automobile vehicle in which the device of the present invention, shown in FIG. 1, is to be installed includes, in a manner that is well known in itself, an engine control system including a computer 1 which controls:

opening and closing of a choke valve 2 in an air inlet pipe 3 of the engine (not shown), operation of injectors on an injector manifold 6, operation of ignition coils 7 for sparkplugs 8, operation of a pressure regulator 9 associated with a high-pressure direct-injection pump 10, and operation of a fuel pump 11, the computer receiving information from a series of sensors 12 measuring various engine parameters such as the airflow, the water temperature or the air temperature, and a pressure sensor 13 measuring the petrol pressure in the manifold 5 of the injectors 6.

The fuel pump 11 is located in a petrol tank 14 and is connected by a pipe 15 to the high-pressure injection pump 10 to feed it with petrol. It is an electric pump connected via the computer to a battery (not shown) of the vehicle and switched on and off by the user of the vehicle to start and stop the engine.

In accordance with the present invention, the pressure regulator 9 takes the form of a three-way valve mounted on or integrated into the high-pressure injection pump 10, whose first port A connects the high-pressure pump 10 to the manifold 6 of the injectors 5, whose second port B connects the pump 10 to the petrol tank 14 downstream of a pressure regulator device and whose third port C connects the fuel pump 11 to the manifold 6 of injectors 5. The port C is totally or partly integrated into the pressure regulator 9.

The high-pressure injection pump 10 is a mechanical pump whose operation depends on the operation of the engine, i.e. the rotation speed of the pump 10 is related to the rotation speed of the engine.

Consequently, the high-pressure pump 10 can feed the manifold 6 of the injectors 5 with petrol at a high pressure which is stabilised by the pressure regulator 9 only from a particular predetermined threshold related to the engine speed.

When the engine is started, it turns at a speed lower than the predetermined threshold but the electrical fuel pump 11 feeds petrol at low pressure into the pipe 15 as soon as it is switched on. The computer 1 then commands closing of the first port A and opening of the third port C. This creates a bypass so that the high-pressure pump 10 is shunted or bypassed and the fuel pump 11 feeds the manifold 6 of the injectors 5 with petrol at a stabilised low pressure.

When the engine is running at a speed above the predetermined threshold, enabling correct operation of the high-pressure pump 10, the computer 1 closes the third port C and opens the first port A of the pressure regulator 9. The high-pressure pump 10 then injects petrol into the manifold 6 at a high pressure and the fuel pump 11 feeds the high-pressure pump 10 with petrol. The second port B is selectively opened by the regulator to allow excess petrol supplied to the manifold 6 to return or flow back to the tank 14.

Finally, when the user stops the engine or if the electrical power supply is cut off, for example by a circuit-breaker in the event of an impact to the vehicle, the system defaults to a configuration in which the port B is opened to encourage fast return of petrol to the tank and thereby reduce the pressure of the petrol remaining in the manifold 6. Thus relief of the high-pressure pump 10 is achieved. This avoids subjecting the injectors 5 to a residual pressure in the manifold 6. This makes the sealing of the injectors (leaks into the cylinders) and evaporation in the system formed by the petrol pipe and the manifold less critical (SHED standards).

Figure 2:
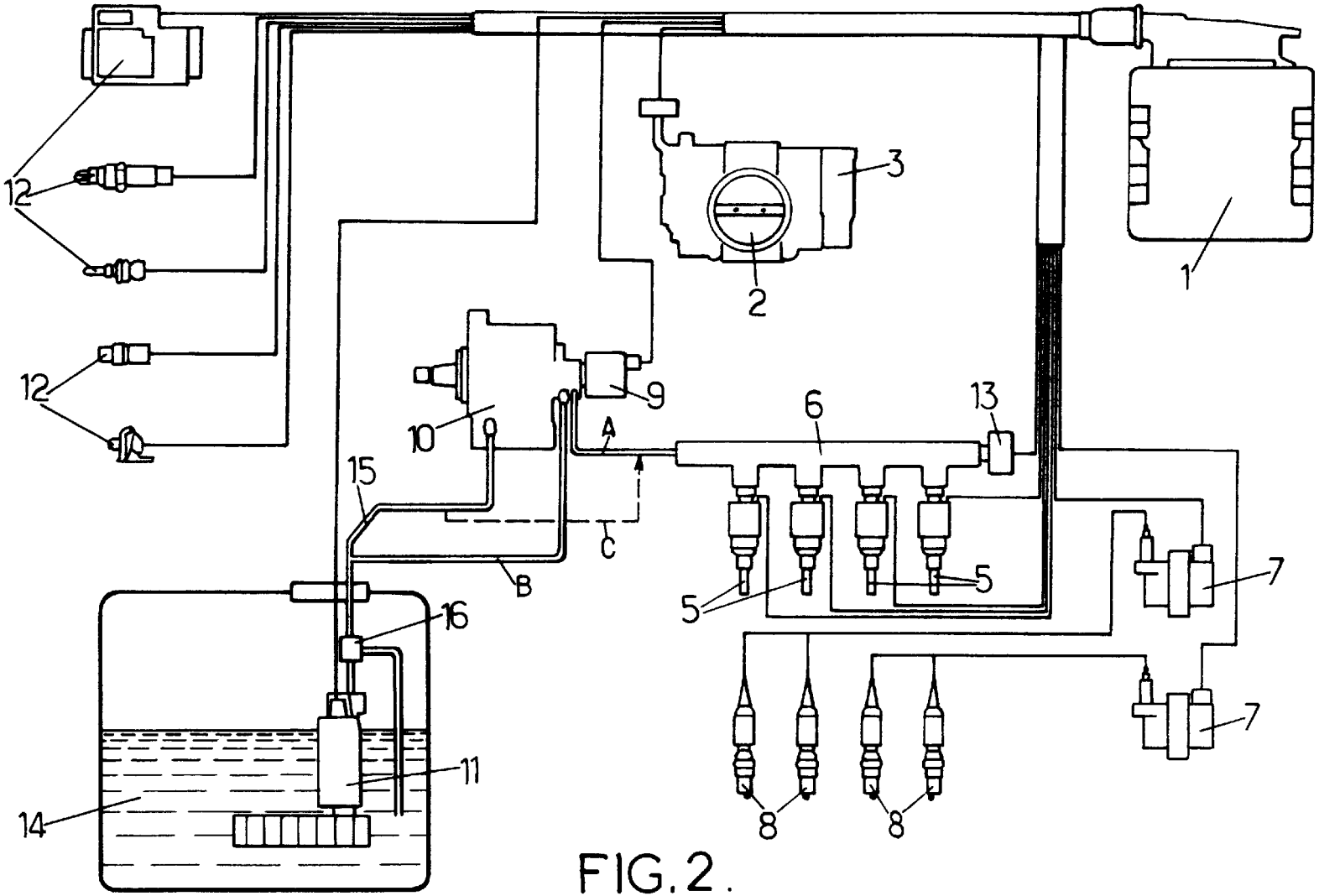
FIG. 2 shows a second embodiment of the relief device of the present invention.

In this first embodiment of the invention, the port B connects the high-pressure pump 10 directly to the petrol tank 14. However, in a second embodiment shown in FIG. 2, the port B is connected to the feed pipe 15 downstream of the fuel pump 11. The fuel pump is provided with a low-pressure regulator 16 which, in the event of disconnection of the power supply from the engine control system, is forced to open in the direction that returns petrol to the tank to relieve the low-pressure and high-pressure network.

The other components of the relief device are similar to those described previously and the second embodiment operates in exactly the same way as that described with reference to FIG. 1.

As an alternative, and in particular during the relief phase, the high-pressure regulator 9 can be controlled by an impact sensor, a sensor responsive to the attitude of the vehicle or any other device for detecting anomalies in the operation of the vehicle, instead of the computer 1.

What is claimed is:

1. A relief device for a high-pressure direct-injection pump for feeding petrol to a manifold of injectors of an automobile vehicle internal combustion engine, the high-pressure pump being connected by a feed pipe to a low-pressure electrical fuel pump which communicates with a fuel tank and the high pressure delivered being regulated by a pressure regulator, wherein the pressure regulator is a three-way regulator with three ports, a first port A connecting the high-pressure pump to the manifold of the injectors, a second port B connecting the high-pressure pump to the tank and a third port C connecting the fuel pump to the manifold of the injectors, the second port B being selectively open in normal operation, the first port A being closed when the third port C is open and vice versa in operation from an electrical power supply, the third port C being:

normally open when the electrical fuel pump is not switched on, in which case the second port B is forced open, held open during the engine starting phase, the fuel pump being energised to supply petrol at a stable low pressure to the injectors, and closed when the engine speed reaches a predetermined threshold corresponding to a rotation speed of the high-pressure pump adapted to supply petrol at a stable high pressure to the injectors.

2. A device according to claim 1, wherein the port B connects the high-pressure pump directly to the tank.

3. A device according to claim 1, wherein the port B is connected to the feed pipe downstream of the fuel pump.

4. A device according to claim 3, wherein the pressure delivered by the fuel pump is regulated by a low-pressure regulator.

5. A device according to claim 1, wherein the third port C is at least partly integrated into the three-way pressure regulator.

6. A device according to claim 1, wherein the third port C is fully integrated into the three-way pressure regulator.

* * * * *